United States Patent [19]

Glenny et al.

[11] 4,401,916

[45] Aug. 30, 1983

[54] HIGH-PRESSURE DISCHARGE LAMP

[75] Inventors: Alfred E. T. Glenny; Johannes A. J. M. van Vliet; Petrus A. M. Weerdesteijn, all of Eindhoven, Netherlands

[73] Assignee: U.S. Philips Corporation, New York, N.Y.

[21] Appl. No.: 125,018

[22] Filed: Feb. 27, 1980

[30] Foreign Application Priority Data

Apr. 3, 1979 [NL] Netherlands ..... 7902574

[51] Int. Cl.[3] ..... H01J 61/073; H01J 61/18

[52] U.S. Cl. ..... 313/628; 313/642; 313/576

[58] Field of Search ..... 313/211, 344, 184, 229, 313/222, 217, 225

[56] References Cited

U.S. PATENT DOCUMENTS

| | | | |
|---|---|---|---|
| 2,060,043 | 11/1936 | Cox | 313/184 X |
| 2,060,610 | 11/1936 | Cox | 313/344 X |
| 2,096,704 | 10/1937 | Burns | 313/225 X |
| 2,105,138 | 1/1938 | Cox | 313/211 |
| 2,110,601 | 3/1938 | Hunt | 313/211 X |
| 2,152,995 | 4/1939 | Holst | 313/184 X |
| 2,219,890 | 10/1940 | Freitag et al. | 313/222 X |
| 2,917,650 | 12/1959 | De Caumont | 313/344 X |
| 3,484,637 | 12/1969 | Van Boort et al. | 313/184 X |
| 3,899,708 | 8/1975 | Tartakoff et al. | 313/222 X |
| 3,937,996 | 2/1976 | Cap | 313/229 X |

*Primary Examiner*—Palmer C. Demeo
*Attorney, Agent, or Firm*—Robert S. Smith

[57] ABSTRACT

A high pressure discharge lamp comprising a discharge vessel in which an electrode comprising a resistive element is present, said resistive element consisting of two parallel arranged branches having substantially the same electrical resistance. With such an electrode construction it is achieved that the starting point of the discharge on the electrode is stabilized.

8 Claims, 3 Drawing Figures

HIGH-PRESSURE DISCHARGE LAMP

Figure 1:
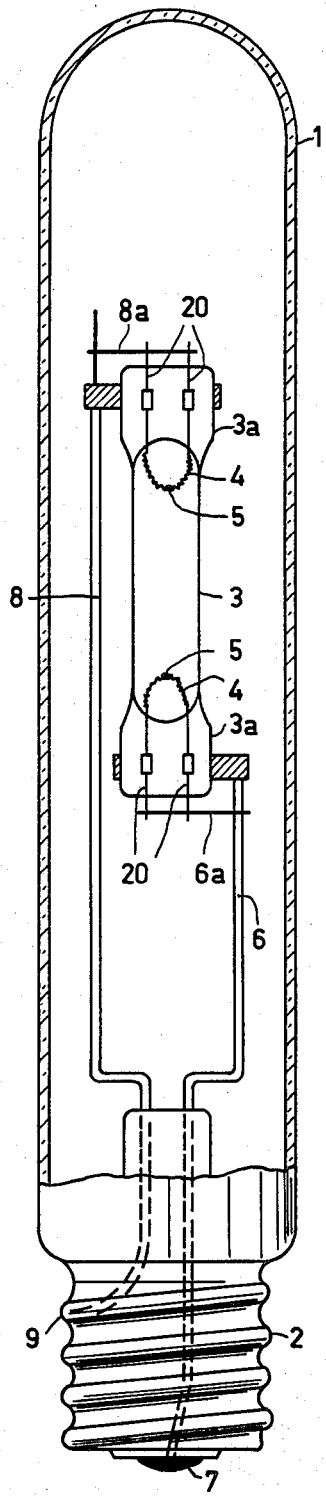

The invention relates to a high-pressure discharge lamp having a discharge vessel containing an ionisable filling and two main electrodes between which during operation of the lamp the discharge is maintained, at least one of said two electrodes comprising a resistive element.

Such a lamp is disclosed in U.S. Pat. No. 3,851,207. A construction of a lamp according to the known patent specification has for its object to increase the temperature of the coldest spot in the discharge vessel. The disadvantage of the known lamp is that the starting point of the discharge on the electrode is not stable. It is the object of the invention to provide a construction in which the starting point of the discharge on the electrode is stabilized at least partly.

According to the invention, a lamp of the kind mentioned in the opening paragraph is characterized in that the resistive element consists of at least two electrically parallel-arranged branches having substantially the same electrical resistance, which branches inside the discharge vessel are interconnected with their ends facing the discharge, the connection point constituting the starting point of the discharge.

If during operation of the lamp the discharge starts at the connection point of the parallel arranged conductors, the conductors will carry substantially the same current load and will have substantially the same temperature. Now if the starting point of the discharge moves to one of the parallel arranged conductors, said conductor will carry a larger current load and its temperature will increase. As a result of this its resistance will become larger. The other conductor will carry a smaller current load and its temperature will drop, as a result of which its resistance will become smaller. The result of the resistance variation is that the current load of one conductor will decrease whereas that of the other conductor will increase. Surprisingly, this has the result that the starting point of the discharge will move back to the connection point of the conductors.

The advantage of a lamp according to the invention is that a result of the construction of the resistive element, a stable starting point of the discharge is obtained during operation of the lamp. It is to be noted that a high-pressure discharge lamp of the kind mentioned in the preamble is disclosed in French patent specification No. 1,467,482, in which a means is present to localize the starting point of the discharge. The means indicated in the French patent specification consists of a partition in the discharge vessel placed between an electrode and the adjacent end part of the discharge vessel. The arrangement of such a partition, however, requires a complicated and expensive construction.

The resistive element preferably consists of a continuous coil of wire which is shaped in the form of a U or V in two parallel arranged branches and that the connection of the two side limbs of the U or V shape is facing the discharge. The advantage of this construction is that the electrode which constitutes the resistive element consists of one coil.

The discharge-facing part of the coil which constitutes the resistive element may be reinforced by means of a core.

In another preferred embodiment of a lamp in accordance with the invention the resistive element consists of a continuous coil of wire which is shaped in two parallel arranged branches, the part of the coil facing the discharge being supported by a supporting wire. The advantage of this preferred embodiment is that large or long electrode constructions can be supported in a simple manner.

To be preferred in a lamp in accordance with the invention in which the resistive element is an incandescent filament. The advantage of the preferred lamp is that a mixed light lamp is obtained having a compact construction. It is very advantageous that the ionizable filling is more rapidly heated by the filament so that a high current load of the filament coil upon igniting the lamp will decrease more rapidly.

The discharge vessel of a lamp in accordance with the invention may contain, for example, a pool of excess sodium. In an advantageous embodiment of a lamp in accordance with the invention, however the ionizable filling comprises mercury and a rare gas. The lamp according to the embodiment, if the resistive element is constructed as an incandescent filament, has the advantage that a comparatively large specific luminous flux is obtainable with very compact dimensions.

The ionizable filling of a lamp in accordance with the advantageous embodiment may advantageously also comprise a halogen. Herewith it is achieved that the filament is in a regenerative atmosphere so that a longer life of the filament can be achieved.

In a further advantageous embodiment of a lamp in accordance with the invention the ionizable filling comprises in addition to mercury and a rare gas, at least one further metal and at least one halogen. This further advantageous embodiment of a lamp in accordance with the invention has for its advantage that the coldest spot of the discharge vessel during operation of the lamp is situated at a better defined place of the discharge vessel so that the lamp has better reproducable properties. It is very advantageous that a directly pinched discharge vessel may be used.

The electrodes may be provided with electron-emissive material having for its advantage that the lamp has lower electrode losses and that the lamp ignites better and reignites better. In a lamp according to the invention the parallel arranged branches are preferably provided with electron-emissive material in the proximity of their interconnected ends facing the discharge. The advantage of this construction is that the stabilizing effect of the construction of the resistive element is intensified.

The invention will now be described in greater detail with reference to a drawing in which FIG. 1 is a longitudinal sectional view of a lamp according to the invention and FIGS. 2 and 3 each show an embodiment of a construction of an electrode comprising the resistive element.

Reference numeral 1 in FIG. 1 denotes an envelope comprising a lamp cap 2. In the space enclosed by the envelope 1 is a discharge vessel 3 having two pinches 3*a*, in which discharge vessel 3 two electrodes 4 are present each having a respective core 5. One electrode is connected to current supply wire 6*a* via a lead-through 20, while the other electrode is connected to a current supply wire 8*a* via an identical lead-through 20. The current supply wires 6*a* and 8*a* respectively, are connected electrically via wires 6 and 8 to the contact points 7 and 9, respectively, of the lamp cap 2.

Figure 2:
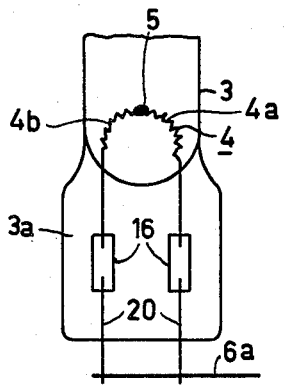

FIG. 2 shows a detail of an electrode construction of the lamp shown in FIG. 1. 3*a* denotes a pinch of the discharge vessel 3, while reference numeral 4 denotes a resistive element which is made as a U-shaped coil with two parallel arranged branches 4*a* and 4*b* in which a core 5 is incorporated at the connection point of the branches for reinforcement. The two coil branches are connected to a current supply wire 6*a* via molybdenum strips 16 and the lead-throughs 20.

Figure 3:
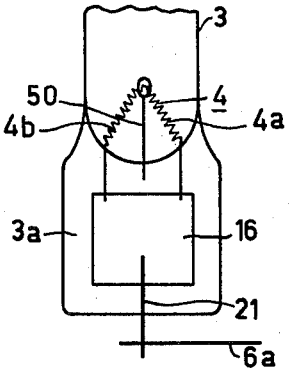

FIG. 3 shows an alternative embodiment of the electrode construction in which corresponding elements are referred to by the same reference numerals as in FIG. 2. In the construction shown the coil 4 is shaped in the form of a V and is centrally supported by a wire 50. In the electrode construction shown in FIG. 3 the two coil branches 4*a* and 4*b* are connected to the current supply wire 6*a* via a single molybdenum strip 16 and a single lead-through connection 21. On the other hand, in the case of an electrode construction shown in FIG. 3, the two coil branches may be alternatively connected to a current supply wire via individual molybdenum strips and individual lead-throughs in the manner shown in FIG. 2. In the case of an electrode construction as shown in FIG. 2 it is possible to connect the two coil branches to the current wire 6*a* by means of a single molybdenum strip 16 and a single lead-through 20 in the manner shown in FIG. 3.

In a first embodiment of a lamp according to the invention having a construction as shown in FIG. 1, the ionizable filling of the discharge vessel comprised 17.5 mgs of mercury and argon having a cold filling pressure of approximately $5.10^3$ Pa. The two electrodes were constructed as incandescent filament coils, each reinforced by means of a respective core. Each filamentary coil was a coiled tungsten wire filament of 56 μm diameter. The overall length of the coil was 22 mm. The core had a diameter of approximately 300 μm and consisted of tungsten. The electrode spacing between the two identically constructed electrodes was 25 mm, while the discharge vessel had an inside diameter of 11 mm. Each coil in the operating condition of the lamp had an overall resistance of 235 Ohm.

The lamp consumed a power of 260 W of which approximately 100 W was dissipated in the discharge and approximately 160 W in the filamentary coils, and was suitable for operation at a supply source of 220 V, 50 Hz. The lamp current was 1.29 A, while the discharge voltage was approximately 110 V. The luminous flux of the lamp was 26 lm/W.

In an otherwise identical lamp the ionizable filling of the discharge vessel, however, contained 22.5 mg of mercury. This lamp had a luminous flux of 25.5 lm/W at a lamp power of 265 W and a supply voltage of 236 V, 50 Hz.

For comparison it is to be noted that a conventional high-pressure mercury vapour discharge lamp of 250 W supplies a luminous flux of 22 lm/W.

In a second embodiment of a lamp according to the invention, the ionizable filling of the discharge vessel consisted of 7.5 mg NaI, 0.8 mg TlI and 0.1 mg InI in addition to 17.7 mg Hg. The discharge vessel also contained argon at a cold filling pressure of approximately $5.10^3$ Pa. The overall lamp power was 240 W and the lamp was operated at a supply voltage of 226 V, 50 Hz, the lamp current being 1.23 A. The lamp had a luminous flux of 49 lm/W at an average colour rendition index of 67 and a colour temperature of 3960 K. In this second embodiment the electrodes were identical to the electrodes of the lamp according to the first embodiment, with the difference that the filament coils were not reinforced by a core. The electrode spacing and the inside diameter of the discharge vessel corresponded to those of the lamp according to the first embodiment.

What is claimed is:

1. A high-pressure discharge lamp having a discharge vessel containing an ionizable filling and first and second main electrodes between which a discharge is maintained during operation of the lamp, at least said first electrode comprising a resistive element comprising at least a continuous wire which is at least partly coiled and having a V-shaped with two branches extending from a single point, each branch having substantially the same electrical resistance, said single point facing the discharge and constituting the starting point of the discharge, said resistive element being in incandescent filament, which consists of a continuous coil and that the discharge-facing part of the coil is supported by a supporting wire.

2. A high-pressure discharge lamp as claimed in claim 1, characterized in that the ionizable filling comprises mercury and a rare gas.

3. A high-pressure discharge lamp as claimed in claim 2, characterized in that the ionizable filling also comprises a halogen.

4. A high-pressure discharge lamp as claimed in claim 1, characterized in that the resistive element is provided with electron-emissive material in the proximity of the interconnected ends facing the discharge.

5. A high-pressure discharge lamp having a discharge vessel containing an ionizable filling and first and second main electrodes between which a discharge is maintained during operation of the lamp, at least said first electrode comprising a resistive element comprising at least a continuous wire which is at least partly coiled and having a U-shaped with two branches extending from a single point, each branch having substantially the same electrical resistance, said single point facing the discharge and constituting the starting point of the discharge, said resistive element being an incandescent filament which consists of a continuous coil and that the discharge-facing part of the coil is supported by a supporting wire.

6. A high-pressure discharge lamp as claimed in claim 5, characterized in that the ionizable filling comprises mercury and a rare gas.

7. A high-pressure discharge lamp as claimed in claim 6, characterized in that the ionizable filling also comprises a halogen.

8. A high-pressure discharge lamp as claimed in claim 5, characterized in that the resistive element is provided with electron-emissive material in the proximity of the interconnected ends facing the discharge.

* * * * *